United States Patent [19]

Fuchigami et al.

[11] 4,418,941

[45] Dec. 6, 1983

[54] COLOR-FORMING SHEET FOR NO-CARBON COPYING PAPER

[75] Inventors: Mitsuru Fuchigami; Mamoru Ishiguro, both of Takasago; Hideo Ohye, Tokyo, all of Japan

[73] Assignee: Mitsubishi Paper Mills, Ltd., Tokyo, Japan

[21] Appl. No.: 312,912

[22] Filed: Oct. 19, 1981

[30] Foreign Application Priority Data

Oct. 22, 1980 [JP] Japan ..... 55-148063

[51] Int. Cl.[3] ..... B41M 5/22

[52] U.S. Cl. ..... 282/27.5; 427/152; 428/124; 428/194; 428/320.6; 428/537

[58] Field of Search ..... 282/27.5; 427/150, 151, 427/152; 428/320.6, 913, 914, 124, 194, 411, 537

[56] References Cited

U.S. PATENT DOCUMENTS

| | | | |
|---|---|---|---|
| 4,289,332 | 9/1981 | Kato | 428/341 |

FOREIGN PATENT DOCUMENTS

| | | | |
|---|---|---|---|
| 50-34510 | 11/1975 | Japan | 282/27.5 |
| 52-24449 | 7/1977 | Japan | 282/27.5 |
| 53-28028 | 8/1978 | Japan | 282/27.5 |
| 54-5328 | 3/1979 | Japan | 282/27.5 |
| 55-113592 | 9/1980 | Japan | 282/27.5 |

*Primary Examiner*—Bruce H. Hess

[57] ABSTRACT

In a color-forming sheet for no-carbon copying paper applied with a coating color basically composed of color former-containing microcapsules, a capsule protective agent and an adhesive, the edge padding aptitude of no-carbon copying papers could be improved by containing in said coating color a surface active agent in an amount of 0.1 to 4% by weight based on the microcapsules.

8 Claims, No Drawings

COLOR-FORMING SHEET FOR NO-CARBON COPYING PAPER

This invention relates to a color-forming sheet for no-carbon copying paper, and more particularly it relates to said color-forming sheet which is capable of improving the so-called edge padding aptitude of no-carbon copying papers.

No-carbon copying paper is known, and it usually consists of a combination of an upper layer sheet (color-forming sheet) coated on its back side with a blend of microcapsules containing a colorless electron-donative organic compound (color former) and a high-boiling organic solvent, a capsule protective agent and an adhesive, and a lower layer sheet (color-developing sheet) coated on its front side with an electron-receptive acidic material which reacts with said colorless electron-donative organic compound to let it develop a color. There is also known an intermediate sheet (serving both as a color-forming sheet and as a color-developing sheet) which is coated on its back side with said color former-containing microcapsules, a capsule protective agent and an adhesive and also coated on its front side with said acidic material, and such intermediate sheet is usually placed between the upper and lower sheets in case that it is desired to obtain a number of copies.

"Edge padding aptitude" is well known in the no-carbon paper industry, but an explanation thereof is given here by way of reference. In case of making the slips into sets of a plural number (for example, n) of sheets, the printed no-carbon copying papers each comprising one upper layer sheet, (n−2) intermediate sheets and one lower layer sheet arranged in that order are properly cut and set, and when a "fan apart adhesive" is applied to the cut faces of the no-carbon copying papers layered in sets each consisting of one upper layer sheet, (n−2) intermediate sheets and one lower layer sheet, the cut faces in each set (between the upper layer sheet and intermediate sheet, between the intermediate sheets and between the intermediate sheet and lower layer sheet) are glued to each other, but the cut faces between the adjoining sets (between the lower layer sheet of one set and the upper layer sheet of the next set) are not bonded but stay separate from each other, thus allowing easy pick-up of an n-sheet set of slips alone. This characteristic is called edge padding aptitude.

Since the coated faces of the color-forming sheet and color-developing sheet oppose to each other in each set while the base papers themselves oppose to each other between the sets, it is considered that the stack of sheets is fanned apart into individual sets depending on the properties of the fan apart adhesive.

Such edge padding aptitude is an important element in the production of no-carbon copying papers, but the process involved many troubles such as too low strength in the individual sets or adhesion between the sets, so that the improvement thereof has been desired.

On the other hand, a marked progress has been seen lately in the art of microencapsulation, and beside the conventional coacervation method which makes use of gelatin, many other methods such as interfacial polymerization method and in situ method have been proposed and put to practical use. Also, there are now in use the microcapsules having a coating film of a synthetic resin such as polyurethane, epoxy resin, urea resin, urea-formaldehyde resin or melamine-formaldehyde resin.

Heretofore, the studies for improving the "edge padding aptitude" have been made principally from the aspect of "fan apart adhesive".

For example, mixing of a gelatin derivative and an aqueous emulsion of a resin is proposed in Japanese Patent Publication No. 7634/75, while use of naphthalenesulfonic acid and formalin condensates is disclosed in Japanese Patent Publication Nos. 12847/78, 12846/78, 21414/78, 21415/78 and 21416/78, and addition of a surface active agent in the fan apart adhesive is attempted in Japanese Patent Publication No. 12844/78. Thus, many studies including the above-mentioned have been made from the aspect of fan apart adhesive, but none of these attempts has attained the fully satisfactory results.

The object of this invention is to provide a color former sheet for no-carbon copying paper which is capable of improving the edge padding aptitude.

This invention has been achieved as a result of the attempt for improving said edge padding aptitude from the aspect of color-forming sheet, and the essential of the invention consists in a color-forming sheet for no-carbon copying paper applied with a coating color basically composed of color former-containing microcapsules, a capsule protecting agent and an adhesive and further characterized in that said coating color contains a surface active agent in an amount of 0.1 to 4% by weight based on said microcapsules.

It has been known to add various types of additives in the color forming sheet, but the object of such addition resided in the improvement of water resistance or the prevention of color fogging or electrostatic charging (see, for example, Japanese Patent Publication Nos. 24449/77, 34510/75, 5328/79 and 28028/78), and the idea of incorporating a surface active agent in the color forming sheet for the improvement of edge padding aptitude has been unknown.

Japanese Patent Laid-Open No. 89111/75 proposes inclusion of a hydrophobic compound free of amino groups as a desensitizer in the support or coating color in the manufacture of pressure sensitive copying paper, and Japanese Patent Laid-Open No. 113592/80 discloses a self-color-forming pressure sensitive copying paper produced by subjecting a slurry comprising a major amount of pulp and a minor amount of color former and color developer (at least one of which is microencapsulated) to a paper making treatment and further size press coating the paper obtained containing both color former and color developer with a size press solution containing a nonionic surface active agent containing no nitrogen atom and having a molecular weight above 2,000 as a desensitizer.

However, these methods published in the Official Gazettes are clearly distinguished from the present invention in that said methods are aimed at preventing color spoiling. They also differ from the present invention in the construction of the invention.

The microcapsules used in this invention are not specified particularly; they may be aforementioned gelatin capsules or synthetic resin capsules, but the effect of the invention is particularly conspicuous in case that the walling film of the microcapsules is made from melamine-formaldehyde resin. This is considered due to poor wettability of melamine-formaldehyde resin to the "fan apart adhesive" in comparison to the microcapsules using other film materials. A variety of known color forming agents may be used as color former to be contained in the microcapsules.

The capsule protective agent used in this invention may be selected from the ordinarily used ones the typical examples of which are cellulose powder, granular starch and synthetic resin emulsions. The only definition is that the protective agent used in this invention must be of a particulate form slightly greater than the microcapsule particles. The adhesive used in a coating color of this invention is also not defined specifically but can be suitably selected from known types of adhesives.

In the present invention, a surface active agent is added in an amount of 0.1 to 4% by weight, preferably 0.1 to 2% by weight, based on the microcapsules. No satisfactory effect is provided if the amount of the surface active agent used is less than 0.1%. Also, its amount in excess of 4% is undesirable for the reasons such that water resistance of the color-forming sheet surface is deteriorated. It was also found that addition of said amount of a surface active agent in the coating color composed of microcapsules, capsule protective agent and adhesive can improve the flow characteristics of said coating color and also has the effect of eliminating "white spot" and "unevenness" on the coated surface.

As regards the surface active agent used for the purpose envisaged, there are available many literatures treating such agent and there will be no need of giving a detailed explanation on such agent here, but as it is considered that the good edge padding aptitude ability has dependence upon the "wetting" facilitating property of the surface active agent, it is desirable to use a hydrophilic surface active agent. Cationic or amine type surface active agents are undesirable as they cause "yellowing" of the coated paper, deteriorate the liquid properties of the coating color and tend to exert an ill influence to the microcapsules.

For the purpose of this invention, anionic and nonionic surface active agents, particularly the latter, are preferred, and it is most preferred to use a hydrophilic nonionic surface active agent having a hydrophilic-lipophilic balance (HLB) of 10 or above.

Although the anionic surface active agents are capable of bettering the edge padding aptitude and improving the flow characteristics of the coating color, their effect is not so high as the nonionic surface active agents. Also, the anionic surface active agents are liable to be affected by the change of pH of the microcapsule coated layer toward the acidic range, which change takes place with passage of time under the influence of the sheet layers which are usually acidic, and in this respect, too, they are inferior to the nonionic surface active agents.

The nonionic surface active agent used in this invention is preferably one which has a rather large molecular weight, or above 200, particularly above 400, as this type of nonionic surface active agent can stay stable on the paper surface for a long time.

It is also desirable that the surface active agent used in this invention has no or a weak desensitizing action, although such desensitizing action may be permitted to some extent, as is the case with the ordinary chemical materials or additives for no-carbon paper.

A typical microcapsule made of melamineformaldehyde resin used in this invention can be easily obtained according to an in situ method described in detail in Japenese Patent Laid-Open Nos. 84881/78 and 49984/79.

A coating color basically composed of microcapsules, a capsule protective agent and an adhesive and containing a surface active agent such as specified above is coated on a paper support in a usual way such as air-knife coating, blade coating, roll coating, etc., and then dried to give a color-forming sheet of this invention.

The invention is further described below by way of the embodiments thereof. In the following Examples, all "parts" are by weight unless otherwise noted.

EXAMPLE 1

200 Parts of a high-boiling oil (KMC-113 by Kureha Chemical Co., Ltd.) having dissolved therein 5 parts of crystal violet lactone (CVL) was emulsified in a 5% styrene-maleic anhydride copolymer solution (pH 5.0) such that the emulsion would have an average particle size of 6μ. Then 20 parts of a 40% aqueous solution of a melamineformaldehyde precondensate (Sumiretz Resin by Sumitomo Chemical Co., Ltd.) was added to said emulsion, and they were reacted at 75° C. for 2 hours, then adjusted in pH to 9.0 with sodium hydroxide and cooled to complete encapsulization. The thus obtained capsules were blended with the materials shown below, and the blend was coated on a plain paper to a coating weight of 42 g/m$^2$.

| | (reduced to solids weight) |
|---|---|
| Capsules | 100 parts |
| Wheat starch | 40 parts |
| Polyvinyl alcohol | 20 parts |
| Polyoxyethylene nonylphenol ether (HLB: 12.6) | 1 part |

200 Sheets of the thus obtained upper layer paper and 200 sheets of a commercially available lower layer paper (Mitsubishi NCR Paper, lower layer sheet, resin coated front, N-40) were piled up alternately to form 200 sets of laminated paper, and they were cut by a guillotine cutter.

An 8% aqueous solution of commercial latex (Polysol by Showa Kobunshi, Ltd.) was applied on the cut faces, and after drying, the edge padding aptitude was examined. Grouping between the sets was perfect, and the adhesion strength in the individual sets was also sufficiently high.

COMPARATIVE EXAMPLE 1

The same process and treatments as in EXAMPLE 1 were followed except that no polyoxyethylene nonylphenol ether was used, and the edge padding aptitude was examined. Grouping between the sets was bad, with several sets being bound to each other. Also, the adhesion strength in the individual sets was not so high.

EXAMPLE 2

EXAMPLE 1 was repeated but by using 2 parts of polyoxyethylene stearate (HLB: 16.9) instead of 1 part of polyoxyethylene nonylphenol ether. The results showed as good edge padding aptitude as in EXAMPLE 1.

EXAMPLE 3

EXAMPLE 1 was repeated by using 0.5 part of polyoxyethylene sorbitan monolaurate (HLB: 14.9) instead of 1 part of polyoxyethylene nonylphenol ether to obtain as good results as in EXAMPLE 1.

What is claimed is:

1. No-carbon copying paper with improved edge padding aptitude layered in sets each comprising one color forming upper sheet and one color developing lower sheet, said color-forming sheet being coated with a coating color basically composed of color former-containing synthetic resin microcapsules, a capsule protective agent and an adhesive, said coating color containing a nonionic surface active agent having a hydrophilic-lipophilic balance (HLB) of 10 or above in an amount of 0.1 to 4% by weight based on the microcapsules, the cut face of the no-carbon copying paper layered in sets being covered with a hydrophilic fan apart adhesive.

2. The no-carbon copying paper according to claim 1, wherein the microcapsules are substantially made from melamine-formaldehyde resin.

3. The no-carbon copying paper according to claim 2 or 1, wherein the nonionic surface active agent has a molecular weight of 200 or above.

4. No-carbon copying paper according to claim 2 wherein the surface active agent has a molecular weight of above 400.

5. No-carbon copying paper according to claim 1 further comprising at least one intermediate sheet serving as both a color forming sheet and a color developing sheet between the upper sheet and the lower sheet.

6. No-carbon copying paper accordng to claim 5 wherein the microcapsules are made substantially from melamine formaldehyde and the surface active agent has a molecular weight of above 400.

7. No-carbon copying paper according to claim 1 wherein the microcapsules are made substantially from melamine formaldehyde and the surface active agent has a molecular weight of above 400.

8. No-carbon copying paper according to claim 1 wherein the surface active agent has a molecular weight of above 400.

* * * * *